US010697190B2

(12) United States Patent
McDuffie et al.

(10) Patent No.: US 10,697,190 B2
(45) Date of Patent: Jun. 30, 2020

(54) POOL GUTTER WITH DECK GRATE ADAPTER

(71) Applicant: Paddock Pool Equipment Company, Inc., Rock Hill, SC (US)

(72) Inventors: Michael McDuffie, Fort Mill, SC (US); Donald Cyrus Baker, Clover, SC (US)

(73) Assignee: Paddock Pools Equipment Company, Inc., Rock Hill, SC (US)

( * ) Notice: Subject to any disclaimer, the term of this patent is extended or adjusted under 35 U.S.C. 154(b) by 0 days.

(21) Appl. No.: 16/229,438

(22) Filed: Dec. 21, 2018

(65) Prior Publication Data

US 2019/0284825 A1 Sep. 19, 2019

Related U.S. Application Data

(60) Provisional application No. 62/609,413, filed on Dec. 22, 2017.

(51) Int. Cl.
*E04H 4/12* (2006.01)

(52) U.S. Cl.
CPC ..... *E04H 4/1227* (2013.01)

(58) Field of Classification Search
CPC ..... E04H 4/1227
USPC ..... 4/510–513
See application file for complete search history.

(56) References Cited

U.S. PATENT DOCUMENTS 3,057,287 A 10/1962 Gray
3,492,761 A 2/1970 Taylor
3,668,714 A 6/1972 Baker
3,835,606 A 9/1974 Liberman
3,844,338 A 10/1974 Hilgemann et al.
3,940,807 A 3/1976 Baker
3,975,780 A 8/1976 Bowen et al.
4,050,104 A 9/1977 Baker
4,080,670 A 3/1978 Van den Broek
4,127,485 A 11/1978 Baker
4,133,058 A 1/1979 Baker
4,133,059 A 1/1979 Baker
4,146,937 A 4/1979 Baker
4,206,522 A 6/1980 Baker
4,389,739 A 6/1983 Baker
4,419,233 A 12/1983 Baker
4,462,125 A 7/1984 Jakowicki
4,542,544 A 9/1985 Baker
4,593,421 A 6/1986 Cohen
4,627,118 A 12/1986 Baker
(Continued)

FOREIGN PATENT DOCUMENTS

CA 2742065 2/2018

*Primary Examiner* — Lori L Baker
(74) *Attorney, Agent, or Firm* — Greer, Burns & Crain, Ltd.

(57) ABSTRACT

A pool perimeter assembly includes conduits extending between the sidewalls, wherein the conduits are separated by a common wall between the sidewalls. A grate is positioned on the gutter apparatus to direct fluid flow into at least one of the conduits. The fluid flow may include water or air. The grate is so dimensioned relative to the gutter apparatus so as to fit within a grate fitting device connected to the gutter assembly. The grate fitting device is a grate angle having at least a riser and a lip. The grate angle may include a welding base used in up-fitting existing pool structures to accommodate new grates.

21 Claims, 12 Drawing Sheets

(56) References Cited

U.S. PATENT DOCUMENTS

| | | | | |
|---|---|---|---|---|
| 4,758,292 | A | 7/1988 | Baker | |
| 4,876,949 | A | 10/1989 | Fairchild | |
| 4,997,558 | A | 3/1991 | Baker | |
| 5,220,698 | A | 6/1993 | Hannant | |
| 5,425,145 | A | 6/1995 | Baker | |
| 5,621,956 | A | 4/1997 | Kolesar | |
| 5,686,696 | A | 11/1997 | Baker | |
| 5,701,615 | A | 12/1997 | Baker | |
| 5,930,850 | A | 8/1999 | Baker | |
| 5,978,979 | A | 11/1999 | Baker | |
| 6,023,793 | A | 2/2000 | Baker | |
| 6,287,459 | B1 * | 9/2001 | Williamson | B01D 17/00 210/164 |
| 6,729,795 | B2 * | 5/2004 | Dahowski | E03F 3/046 210/164 |
| D515,183 | S | 2/2006 | Nigro et al. | |
| 7,137,155 | B2 * | 11/2006 | Sugranes Arimany | E04H 4/1227 4/506 |
| 9,540,836 | B2 | 1/2017 | Baker | |
| 9,631,387 | B2 | 4/2017 | Baker | |
| 10,072,868 | B2 | 9/2018 | Baker | |
| 2009/0139019 | A1 | 6/2009 | Shebek et al. | |
| 2009/0183453 | A1 | 7/2009 | Koessler et al. | |
| 2009/0233540 | A1 | 9/2009 | Valentino | |
| 2010/0050335 | A1 | 3/2010 | Baker | |
| 2010/0258206 | A1 | 10/2010 | Baker | |
| 2011/0244782 | A1 | 10/2011 | Baker | |
| 2014/0117102 | A1 | 5/2014 | Baker | |

* cited by examiner

POOL GUTTER WITH DECK GRATE ADAPTER

CROSS REFERENCE TO RELATED APPLICATIONS

This application is a non-provisional of and claims priority to U.S. Provisional Patent Application Ser. No. 62/609,413, filed Dec. 22, 2017, entitled Pool Gutter with Deck Grate Adapter, the same being incorporated by reference herein as if fully set forth in this document.

FIELD OF THE DISCLOSURE

This disclosure relates to devices installed around a pool perimeter including gutter assemblies directing water from the pool to a filtration system and evacuation assemblies directing contaminated air from the surface of the pool and into an exhaust system.

BACKGROUND

The chemicals used to treat water in a swimming pool create contaminants that may be harmful to swimmers and others present within an enclosure housing a swimming pool (e.g., a natatorium). The water in the swimming pool also creates water vapor (i.e., humidity) within the swimming pool facility. The contaminants (e.g., chloramine) can irritate the eyes and air passages of individuals in and around the pool area. The contaminants such as chloramine are present in the air within the swimming pool enclosure, but are concentrated in an area immediately above the surface of the swimming pool. Unfortunately, greater amounts of chloramine are created when the swimming pool is in use due to swimmers agitating the water (e.g., swimming and splashing). Moreover, the high humidity within the enclosure creates an uncomfortable environment for individuals and can affect the physical structure (e.g., girders and roofing) forming the enclosure (e.g., corrosion).

Moreover, the high humidity formed within the enclosure housing a swimming pool requires that a heating, ventilating, and air conditioning (HVAC) system run almost continuously to circulate and dehumidify the air contained within the enclosure. In addition, the HVAC system runs nearly continuously to circulate the air in order to avoid high concentrations of contaminants in the air.

Prior art FIGS. 1-3 illustrate previously disclosed deck drain gutter assemblies (20) for installing along a pool perimeter (10). The gutter assemblies include conduits formed by sidewalls (16A, 16B), lower wall (15), and grate (21). One of the conduits is a filtered pool water return tube (11) that replenishes the pool in an ongoing filtration system, and another conduit may be a contaminated air removal conduit, designated in FIG. 1 as a perimeter plenum (12) that transports air to a contaminated air removal exhaust system (13), as shown in FIGS. 2-3. Each perimeter plenum (12) defines an exhaust port (22) through which contaminated air proximate the pool, especially above the surface of the pool, is forced toward the perimeter plenum for transport by the exhaust system (13) to an outside area or an air filtration system.

An HVAC system directs air pressure onto and/or across a surface of the pool to force the above noted contaminated air into one or more of the exhaust ports (22). FIG. 2 illustrates that the perimeter assembly incorporating the perimeter plenum (12) and exhaust ports (22) may evacuate air from areas all the way around the pool perimeter, such as when an HVAC system directs air pressure from the top down, and the exhaust system (13) draws contaminated air into the exhaust ports (22). FIG. 3 illustrates that the HVAC system may incorporate air duct configurations that direct air pressure from only one, or any number less than all, of the number of sides of the pool and push the air into exhaust ports (22) installed on other sides of the pool perimeter plenum.

It is desirable therefore to reduce the levels of contaminants and humidity within the enclosure housing a swimming pool. Moreover, it is desirable for swimming pool facilities to improve the efficiency of the HVAC system in order to reduce costs associated with circulating, filtering, and dehumidifying the air within the swimming pool facility.

Accordingly, the present invention addresses the requirements for an energy-efficient apparatus and method for evacuating contaminants and water vapor from a swimming pool facility.

BRIEF SUMMARY OF THE DISCLOSURE

In one embodiment, an apparatus for directing fluid flow around a pool includes a pool perimeter assembly defining at least two conduits extending between a first sidewall and a second sidewall. The conduits are separated by a common wall between the first sidewall and the second sidewall. A grate is positioned on the pool perimeter assembly in a position to direct fluid flow into at least one of the conduits, and the grate defines a hand hold section that drains into one of the conduits. A grate fitting device is connected to the pool perimeter assembly and defines a lip into which the grate enters for positioning proximate at least one of the conduits.

DETAILED DESCRIPTION

Figure 1:
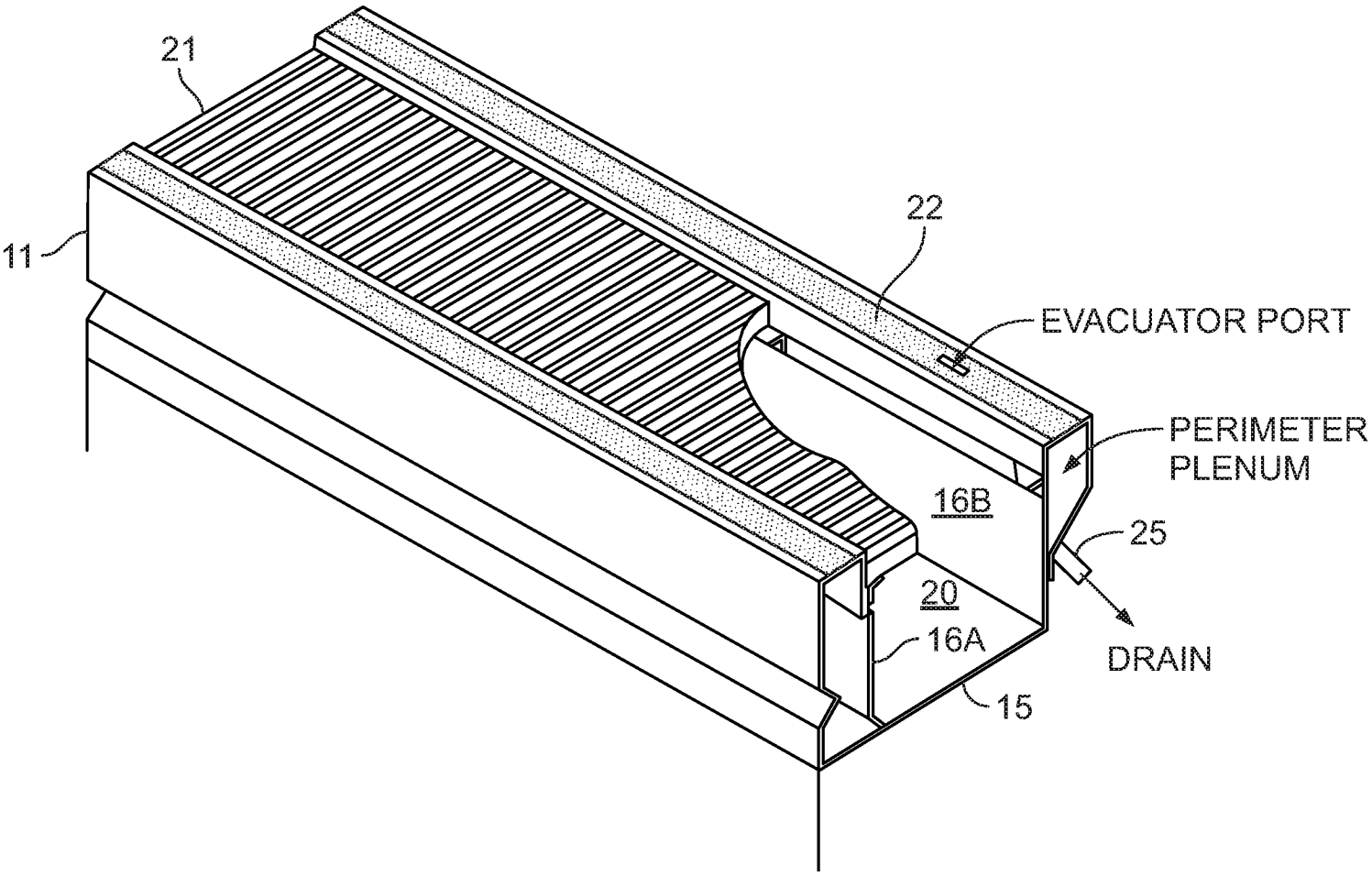
FIG. 1 (Prior Art)
FIG. 1 is a PRIOR ART perspective view of a gutter and perimeter plenum assembly for installation around a pool.
Figure 2:
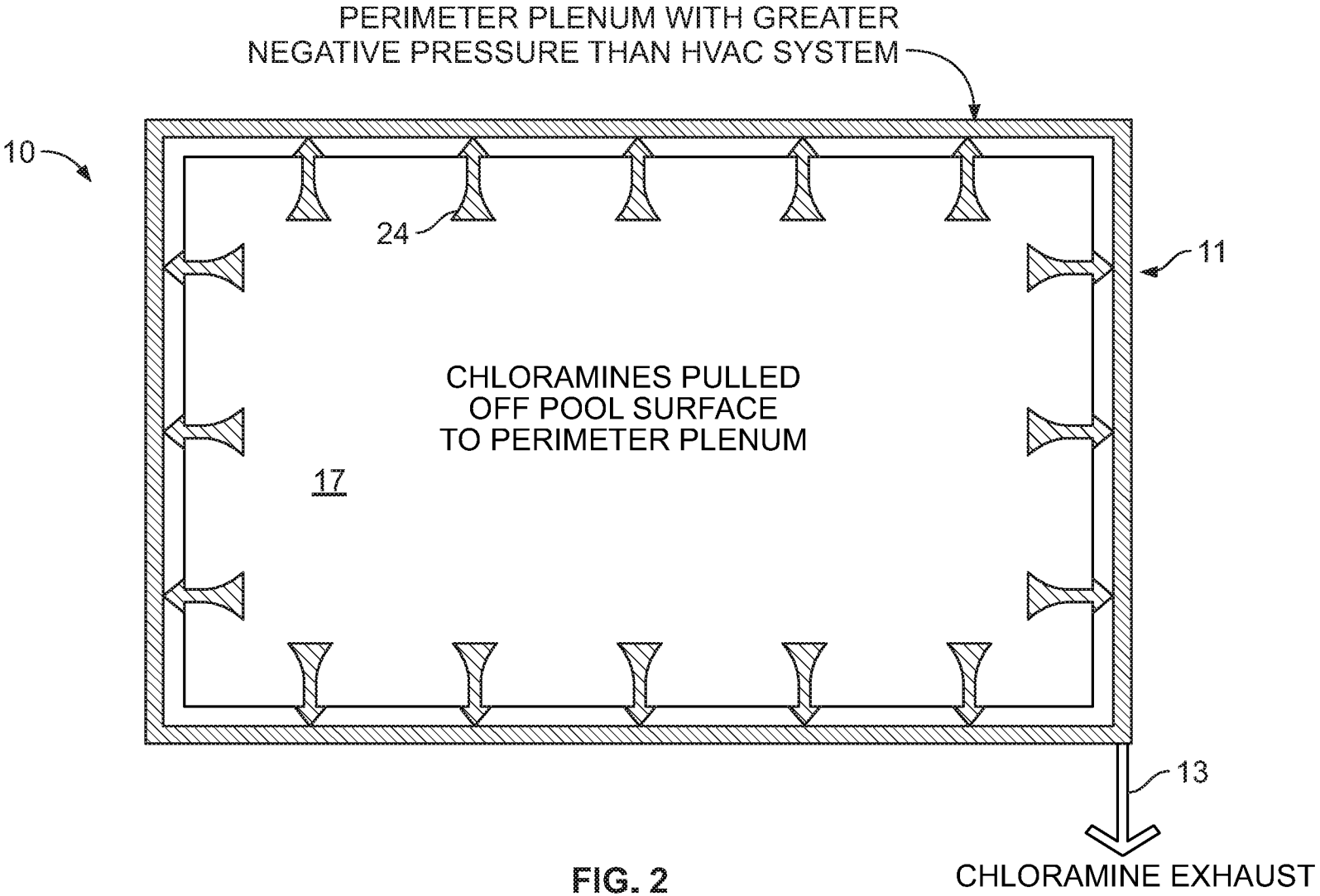
FIG. 2 (Prior Art)
FIG. 2 is a PRIOR ART plan view of a pool having a perimeter construction using the gutter and perimeter plenum assembly of FIG. 1.
Figure 3:
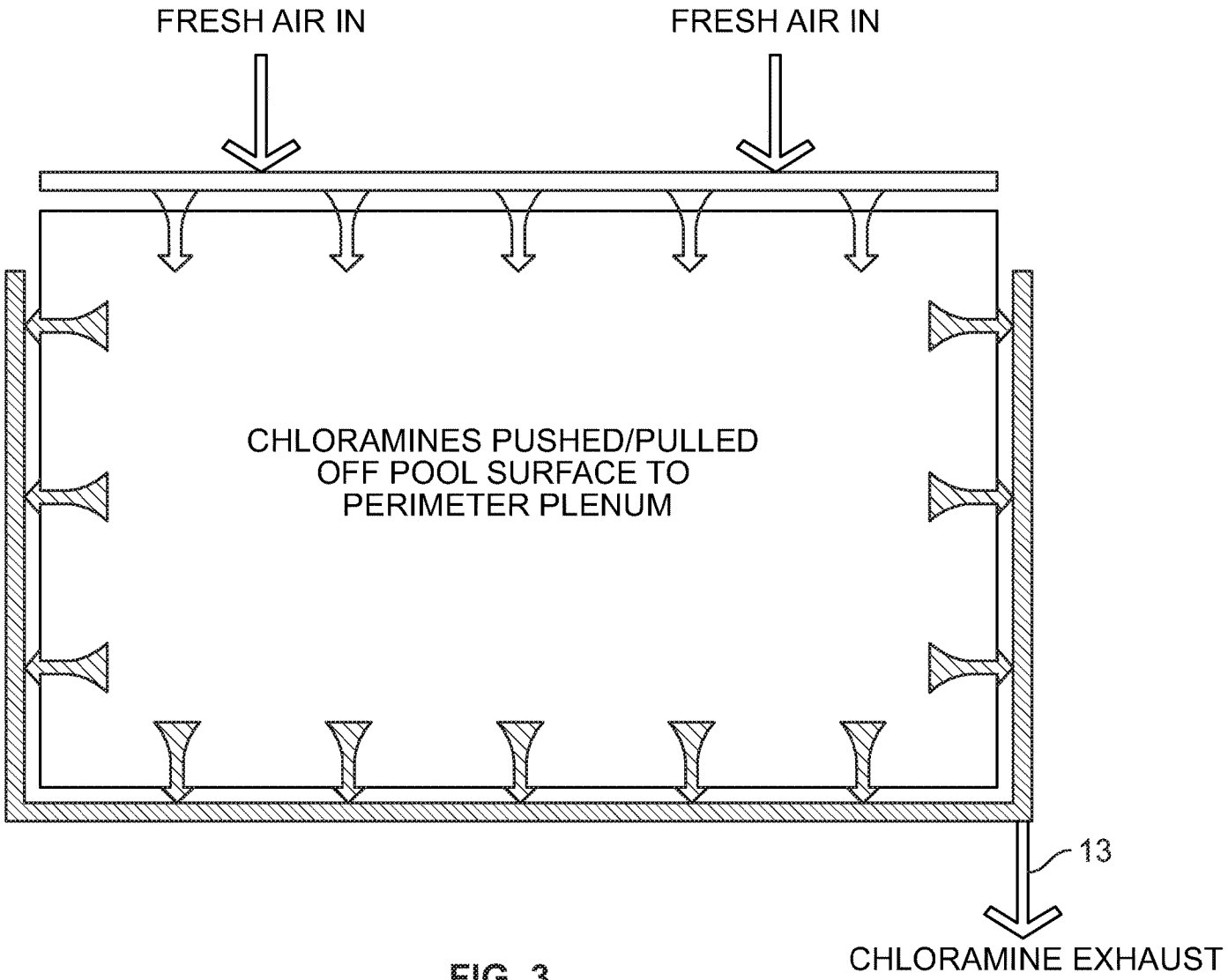
FIG. 3 (Prior Art)
FIG. 3 is a PRIOR ART plan view of a pool having a perimeter construction using the gutter and perimeter plenum assembly of FIG. 1 on less than all sides of the pool.
Figure 4:
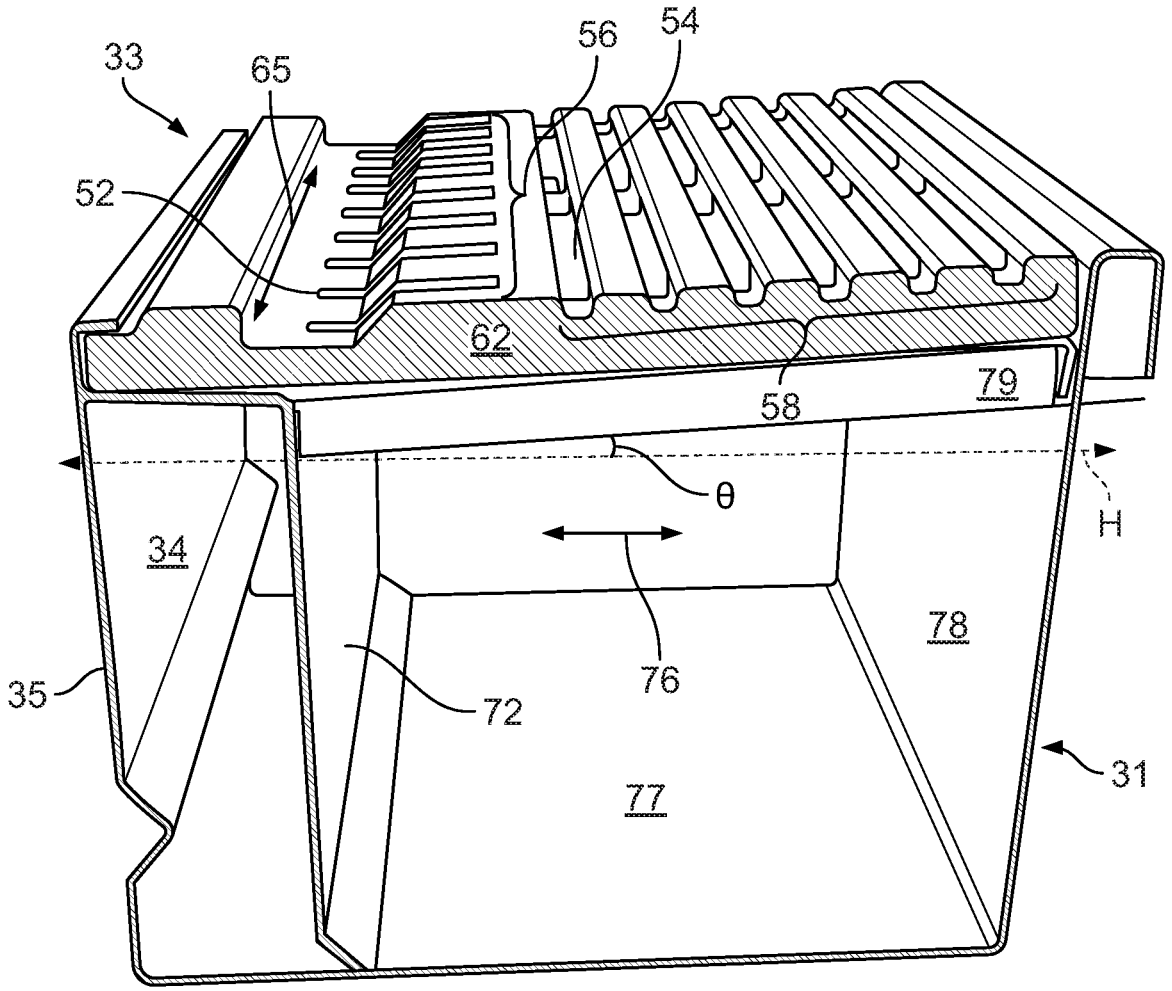
FIG. 4 is a side cross section view of a gutter apparatus having a grate thereon and connected to a pool water return conduit as disclosed herein.

One embodiment of this disclosure, which is not limiting of the embodiments but merely shown for example, is a pool perimeter assembly that incorporates the deck drain apparatus (33) of FIG. 4. In FIG. 4, the deck drain apparatus (33) is shown as incorporating two conduits—a filtered water return conduit (34) and a deck drain gutter conduit (76) into which backsplash from the pool and/or excess water collecting on a deck surrounding the pool enters through a grate (62). The grate (62) defines drain ports (52) aligned about the grate surface in a series (56), and optionally, another series (58) of different grate ports (54) that may be oriented in a different direction. In the example embodiment of FIG. 4, the distinct series (56, 58) of grate ports (52, 54) are perpendicular to one another, but other respective directions are equally available for manufacture. The deck drain grate (62) of FIG. 4 is characterized in part by defining a hand-hold section (65) that defines a convenient grip (145) for a person's hand when that person is in the pool and proximate the perimeter assembly. The hand hold section may be divided into components including the grip (145) rising above a recess (148). The hand-hold section (65) is further configured for installation with the hand-hold section defining one of the above described series (56) of ports (52) that drain into the deck drain gutter conduit (76). The ports (52) within the grate that are closest to the hand-hold section (65) direct back-splashed liquid from the pool out of the hand-hold section (65), through the ports (52), and into the deck drain gutter conduit (76)). The remaining ports (54) in the grate (62) direct water that is splashed out of and/or beyond the hand-hold section (65) from the pool into the deck drain gutter conduit (76). The return conduit (34) has a construction configured for installation proximate the pool and between the deck drain gutter conduit (76) and the pool. The deck drain gutter conduit (76) may have a variety of shapes and designs as needed for the installation at hand, but FIG. 4 illustrates one of such configurations in which the deck drain gutter conduit (76) is defined by sidewalls (72, 78) connected by a horizontal base (77). A support structure (79) may also connect the sidewalls on respective ends opposite the base (77). The support structure (79) is positioned to support the grate (62) without interfering with the ports (52, 54) opening into the deck drain gutter conduit (76).

FIG. 4 illustrates another feature of the deck drain apparatus (33) that aids in more efficient water removal areas around a pool of liquid, such as a deck area around a swimming pool. In one example embodiment, that does not limit the scope of installations relevant to this disclosure, the deck drain assembly (33) has a construction in which the outermost wall (35) of the return conduit (34), relative to the overall assembly (33), is configured such that the grate (62) rests on the assembly (33) in a position that includes an angle of incline (theta) relative to a horizontal (H) extending from a pool edge. In other words, in one installation, a pool having a pool side structure (i.e., pool wall) enclosing a body of liquid, supports an adjacent filtered water return conduit (34) having an outermost wall (35) proximate the pool side structure. Wall (35) includes a "V" bend (36). The pool side structure typically includes a top edge defining at least one horizontal (H) axis for purposes of a point of reference herein only. In the embodiment of FIG. 4, the grate (62) rests on the deck drain apparatus (33) such that the grate (62) is elevated along a surface (31) opposite the water return conduit (34). Such assembly provides additional back splash capacity without restricting use of an associated deck. In one non-limiting embodiment, there is a one-inch difference in elevation, relative to horizontal (H) from the pool side (i.e., the outer most side (35) of the filtered water return conduit (34)) to an opposite side wall (78) or outer surface (31) of the side wall particularly in regard to the base (77).

Figure 5A:
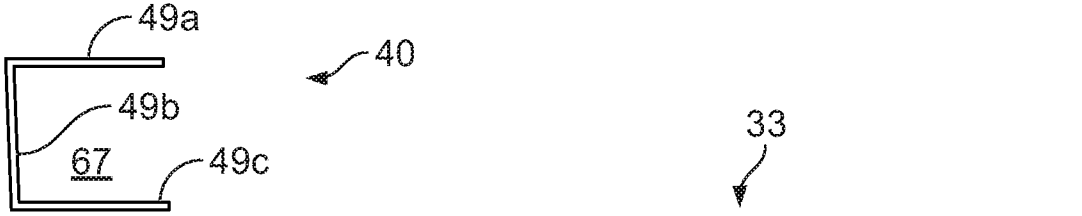
FIG. 5A illustrates a side cross section view of a grate fitting device as described herein.
Figure 5C:
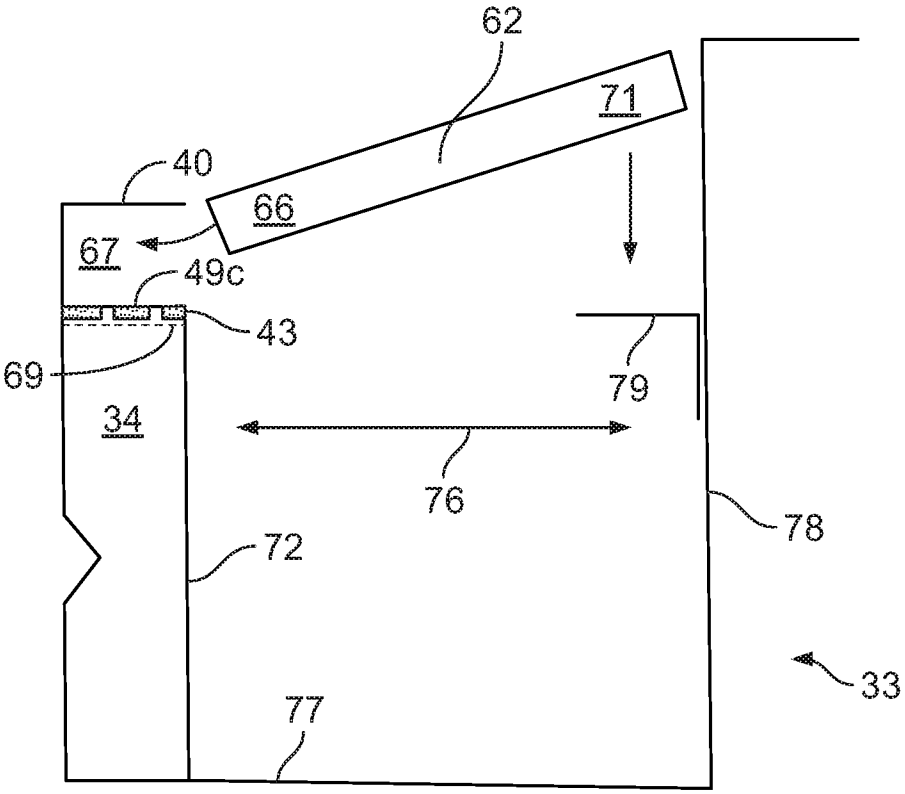
FIG. 5C illustrates a side cross section view of a pool perimeter assembly having a return conduit with a grate fitting device connected thereto via a connector portion alongside a gutter trough for use with a pool perimeter construction as disclosed herein.
Figure 5B:
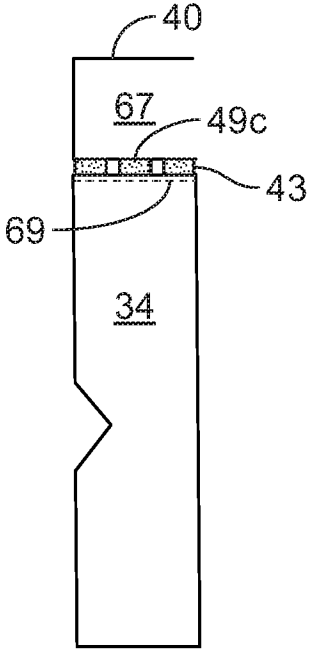
FIG. 5B illustrates a return conduit portion of a gutter assembly having a grate fitting device connected thereto via a connector portion as described herein.
Figure 11:
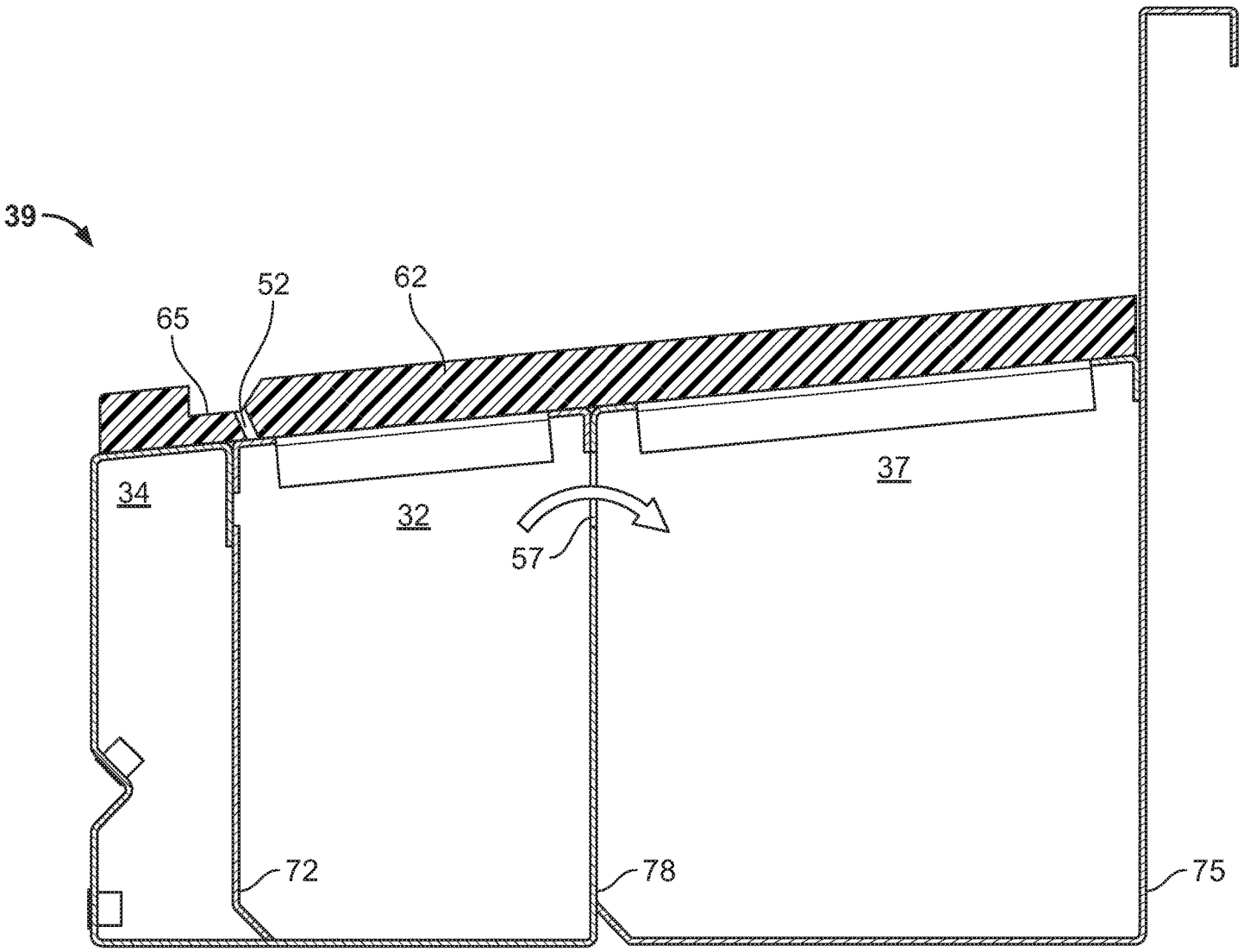
FIG. 11 is a side cross section view of a pool perimeter assembly having a return conduit and two conduits for use with a pool perimeter construction as disclosed herein.
Figure 12:
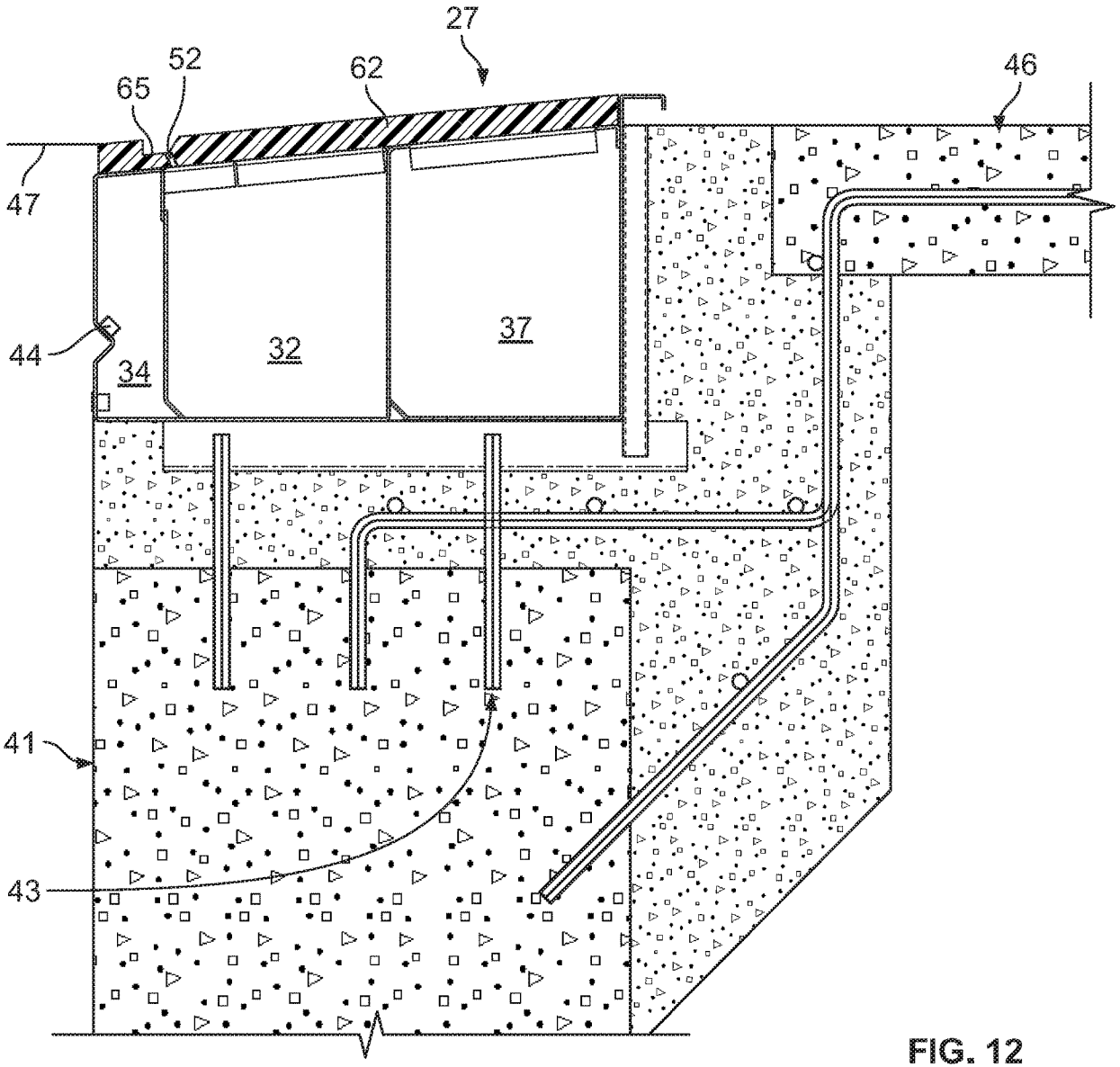
FIG. 12 is a side cross section view of a pool perimeter assembly installed on a foundation around a pool wall having multiple conduits.

FIG. 5 illustrates yet another embodiment that includes another construction for a multi-conduit deck drain apparatus (39). Similar to the embodiment of FIG. 4, the multi-conduit construction incorporates the filtered water return conduit (34) configured for installation alongside a pool side structure enclosing a body of liquid. With a single deck drain gutter conduit (76) described above, the embodiment of FIGS. 5A-5C incorporates a multi-conduit construction (34, 76) that includes the return conduit (34), a gutter trough conduit (76), and a grate fitting device (40). Similar constructions are illustrated in co-pending U.S. Provisional Patent Application 62/598,027 entitled Pool Gutter and Evacuator Assembly, incorporated by reference in its entirety herein. As shown in FIGS. 11 and 12 of the present application such constructions include an extra gutter trough conduit (37) having a dual purpose, depending on its position relative to an associated pool of water. In the embodiment of FIG. 11, the extra gutter trough conduit (37) is adjacent the gutter trough conduit (32) such that the gutter trough conduit (32) is between the extra gutter trough conduit (37) and the filtered water return conduit (34). In this position the extra gutter trough conduit (37) is available for additional water removal from back splash water from a pool or from water accumulating on the deck. In extreme instances, the gutter trough conduit (32) may fill to capacity during times of heavy use of the pool, such as when a swimming pool is full of swimmers and at capacity. In this scenario, when the gutter trough conduit (32) fills to a predefined limit, an overflow port (57) is available to allow drainage into the extra gutter trough conduit (32). In the embodiment of FIG. 12, the extra gutter trough conduit (37) is used as an air exhaust conduit along a designation section of the pool perimeter. In the embodiments of FIGS. 11 and 12, the grate (62) extends over all of the conduits in the deck drain assembly (39), and includes the ports as described for FIG. 4 of this disclosure.

In terms of construction, the filtered water return conduit (34) may have a structure similar to that described above with an outermost wall (35) connected or directly proximate a side structure of a pool. The deck-drain gutter trough conduit (76) is between the return conduit (34) and an opposite side of a pool perimeter assembly. Respective sidewalls define the conduits, and these sidewalls may include commonly shared wall structures or separate wall structures that are merely close together or connected together at select points. In one embodiment, shown in FIG. 4 of this disclosure, a common wall (72) separates a first sidewall (35) and second sidewall (78) of the overall deck drain assembly (33). The angle of inclination (theta) is also depicted in FIG. 4 herein from left to right on the figure (defining an incline of a measured amount, e.g., a three fourths inch elevation from an outermost wall (35) to second sidewall (78)).

FIGS. 5A-5C illustrate a non-limiting embodiment of this disclosure by which a grate assembly including a grate (62) and a grate fitting device (40) may be usable in more diverse installations, such as pre-existing gutter assemblies installed in previously constructed pools. FIG. 5A illustrates one design, shape, and structural functionality for a grate fitting device (40) having three sides (49*a*, 49*b*, 49*c*). FIG. 5B illustrates that one of the sides (i.e., 49*c*) may be used as a point of attachment (43) to a conduit (34) in a gutter assembly (33). In one embodiment, the grate fitting device (40) is connected to the filtered water return conduit (34) by welding a joint as the point of attachment (43) onto the roof, or top side (69), of the conduit (34). Other methods of connecting the grate fitting device (40) to the gutter assembly (33) may include various adhesives or even mechanical fasteners as the installation allows. As shown in FIG. 5C, the grate fitting device (40) defines a lip (67), in an open configuration, that receives a portion of the grate (62) identified as a leading edge (66) therein with another portion, or trailing edge (71), at an opposite side of the grate (62) and resting on a grate support (79). The grate fitting device (40) can be attached as a later added portion for a new kind of grate installation in either new or legacy pool installations.

Figure 6:
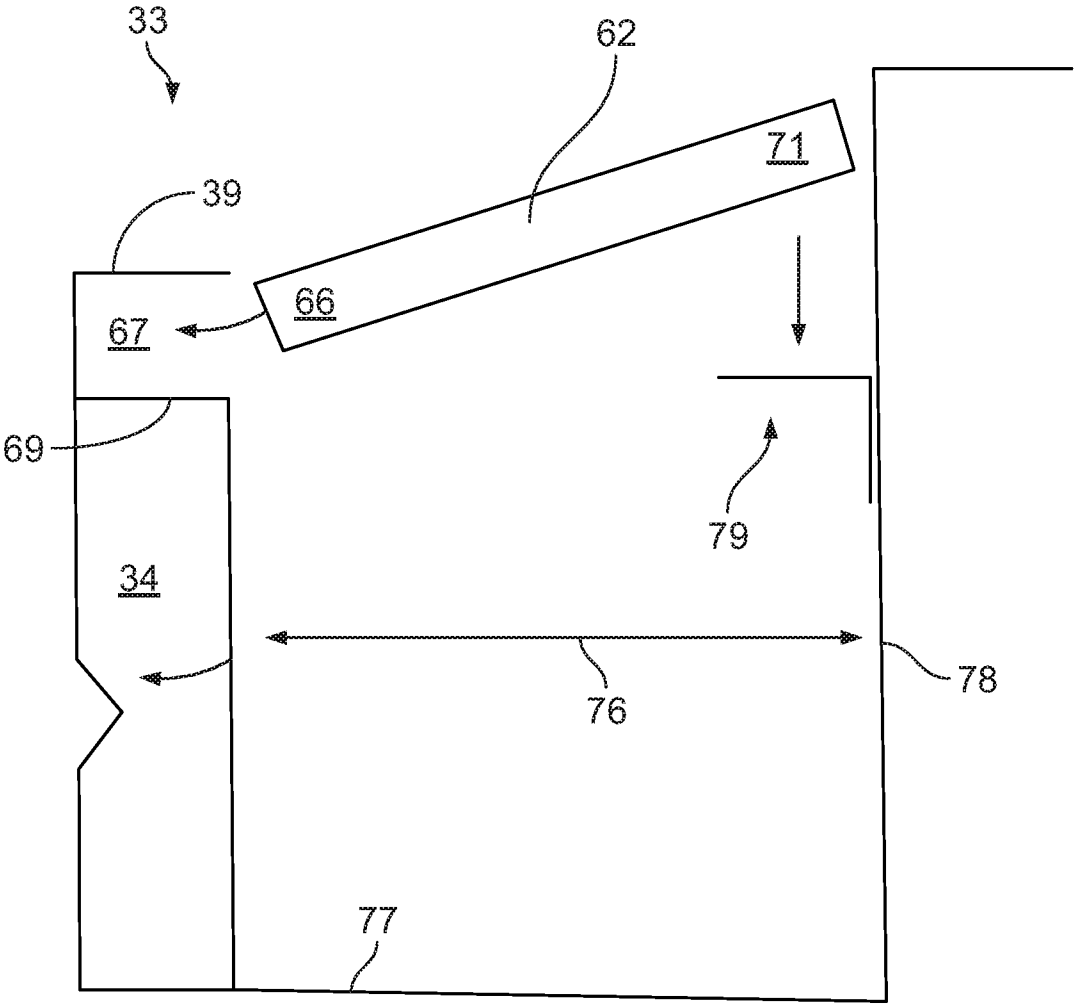
FIG. 6 illustrates a side cross section view of a pool perimeter assembly having a return conduit with a grate fitting device integral to the return conduit as a one-piece assembly for use with a pool perimeter construction as disclosed herein.

FIG. 6 illustrates a similar concept as discussed for FIG. 5, but using a lip structure (39) that is integral with an overall gutter assembly. In the example of FIG. 6, at least a portion of the gutter assembly, or possibly the entire gutter assembly includes a single piece construction that incorporates an integral grate fitting device (39). In other words, at least one portion of the gutter assembly, if not the whole gutter assembly (33), could be manufactured with the lip (67) structure. FIG. 6 is shown with an angled opening receiving one end (66) of a pool grate (62) and configured for serving as a gutter fitting device (40), that is integral to and not separable from the gutter assembly (33).

Figure 7B:
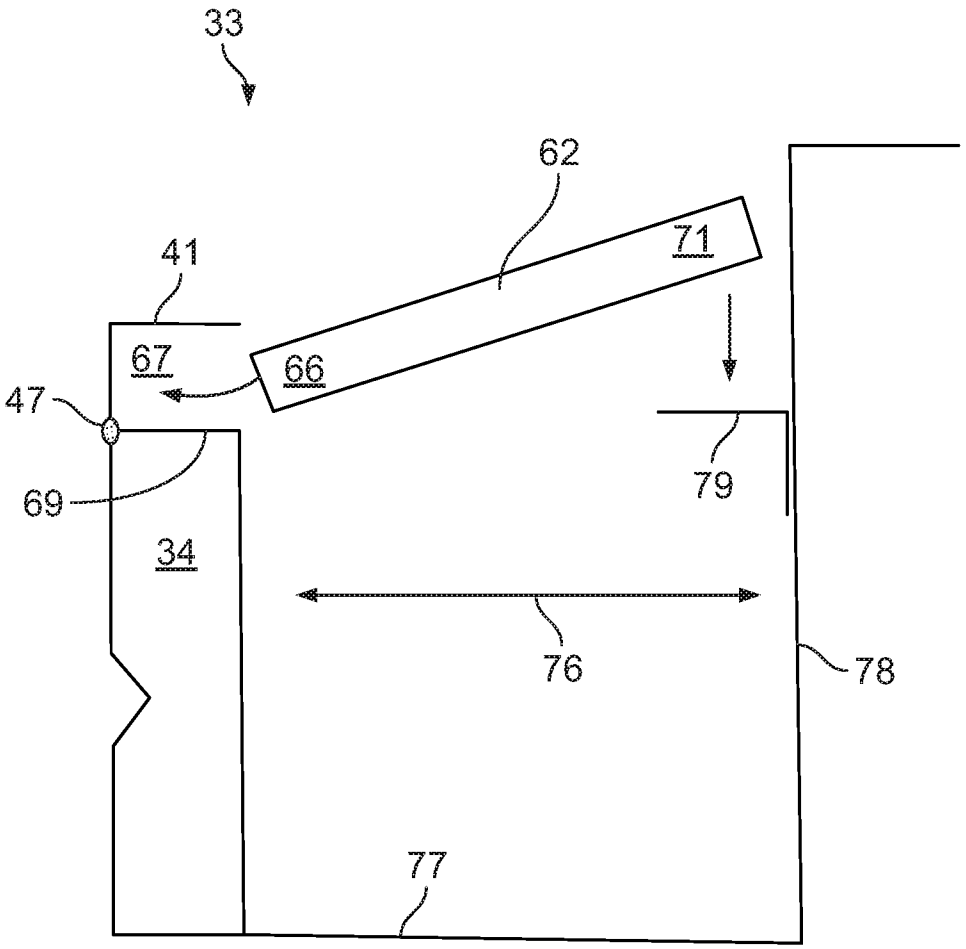
FIG. 7B illustrates a side cross section view of a return conduit having the two-sided angled grate fitting device of FIG. 7A attached to the return conduit by a spot weld.
Figure 7A:
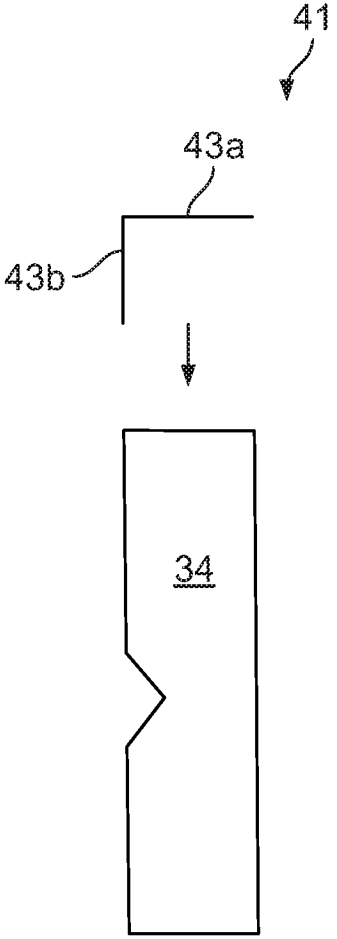
FIG. 7A illustrates a side cross section view of a filtered water return conduit from an overall grate assembly having a two-sided angled grate fitting device configured for attaching thereto.

FIG. 7 illustrates yet another use for the multi-conduit deck drain gutter assembly (33) that may be installed as at least a portion of a pool perimeter assembly. The pool perimeter assembly of FIG. 7 illustrates how the multi-conduit gutter assembly (33) of FIGS. 5-6 may be used for disparate purposes along respective sections of a pool perimeter. In FIG. 7, a gutter assembly (33) may be positioned around sides of a pool perimeter, for example only and without limiting the disclosure, and configured for using the above described gutter trough (76) for water overflow. FIG. 7A illustrates one example of a gutter fitting device (41) that is a two-sided (43*a*, 43*b*) angle structure configured to mate, attach, or be conjoined by an attachment mechanism to a region or portion of the gutter assembly (33), such as the return conduit (34) shown in FIG. 7A. In FIG. 7B, the multi-conduit gutter assembly (33) includes two exemplary conduits—the filtered water return tube (34) and the gutter trench conduit (76). Other embodiments of this disclosure may incorporate additional, extra gutter trench conduits as set forth in the above-referenced U.S. Provisional Patent Application 62/598,027 entitled Pool Gutter and Evacuator Assembly, that has been incorporated by reference in its entirety as if set forth herein. The gutter trench conduit (76) and any extra gutter trench conduit (37) direct water and/or air out of the pool installation via perimeter overflow outlets connected or designed within the gutter trench assembly. These perimeter overflow outlets direct back-splashed water from the pool and collected water from the deck (46) into a water removal system with components such as a surge tank, a strainer, a pump, filters, filtered water return lines, etc. that collectively meet regulatory requirements for clean liquids/water in the pool.

FIG. 7 further illustrates that a side of the pool may define a pool wall that is available to attach the illustrated embodiment of a pool grate fitting device (41), which in the example shown in FIG. 7A and FIG. 7B is a two-sided angle structure (41) that may be welded to a portion of the gutter assembly (33). Other methods of connecting the grate fitting device (40) to the gutter assembly (33) may include various adhesives, mating portions of the devices, or even mechanical fasteners as the installation allows. As shown in the FIG. 7A, the two sides (43*a*, 43*b*) of the grate fitting device (41) may be a single piece construction but other structures that may be connected to a gutter assembly (33) as shown in FIG. 7B are also within the scope of this disclosure. In the example shown, a weld (47) may be a spot weld connecting the gutter assembly (33) to the grate fitting device (41). Again, the two sided grate fitting device (41) defines the same kind of lip (67) configuration for a leading edge (66) of the grate (62) to slide into and position a trailing edge of the grate (71) for resting on a grate support (79). This assembly allows for securing and then removing a grate section as desired.

Figure 8:
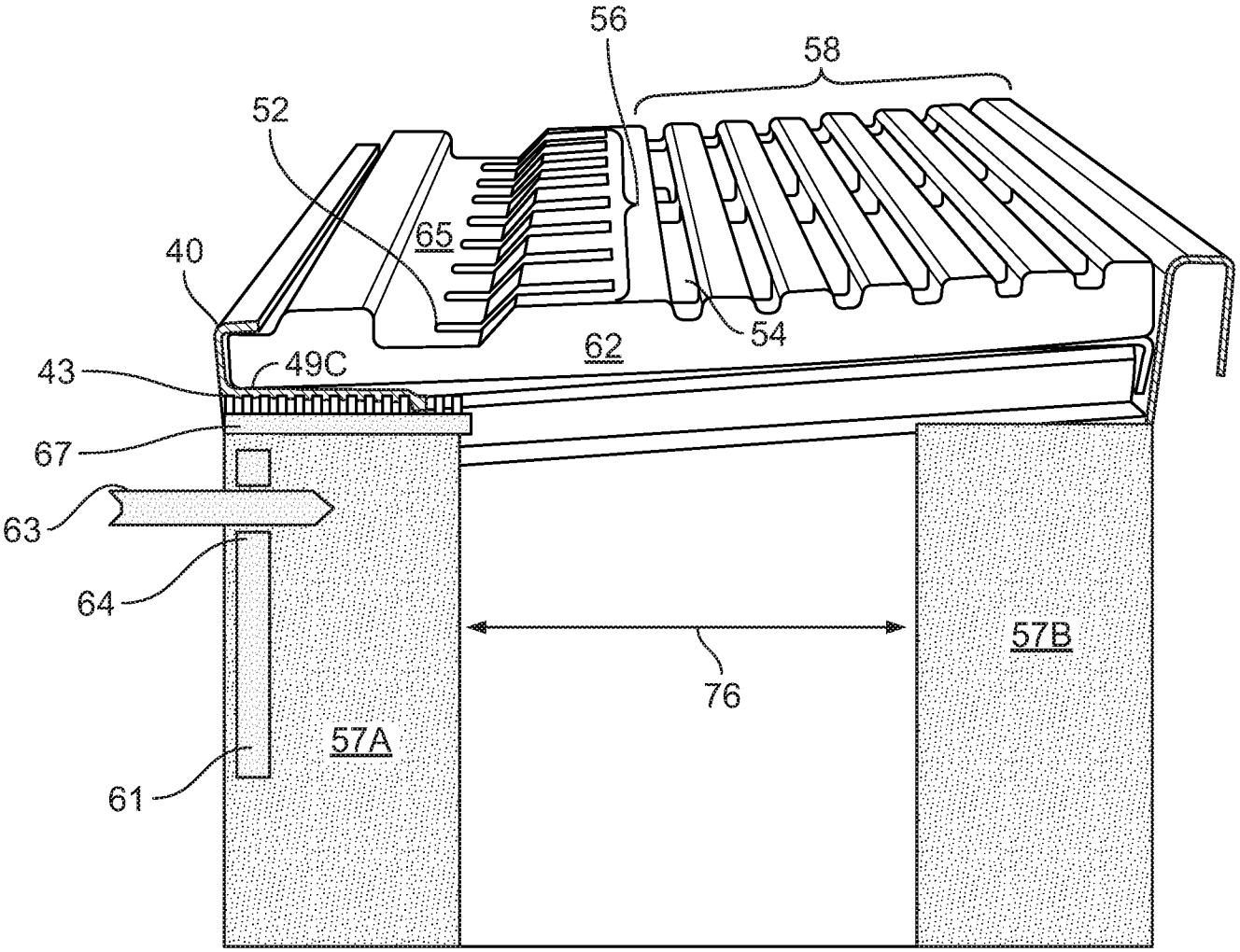
FIG. 8 illustrates a side cross section view of a gutter assembly having a grate positioned thereon and within a grate fitting device connected to the gutter assembly via a gutter plate assembly and welded joint.

FIG. 8 illustrates yet another embodiment in which a gutter fitting device (40), such as either of the separate angle formations (40, 41) for a grate fitting device may be attached to a pool perimeter installation, regardless of the pool wall construction. In the example of FIG. 8, which is not limiting of the disclosure herein, the pool perimeter assembly may be a concrete pool wall (57A, 57B) construction. In order to either up-fit an existing concrete pool installation or to install a particular size of grate (62) onto a concrete design, the methods, structures and systems of this disclosure may utilize a grate fitting device (39, 40, 41) connected to the concrete pool wall (57A) via a gutter plate system having gutter plates (61, 67) along respective edges of the concrete structures (57A, 57B). A first gutter plate (61) may define an opening (64) through which a welding bolt (63) fits and engages the concrete structure (57A) of the pool wall. By welding and bolting the system of gutter plates (61, 67) onto the concrete structures, the gutter plates provide at least one surface (67) onto which the grate fitting device (40) may be connected by means, such as but not limited to, the welded surfaces of one side (49C) of the grate fitting device (40) and a corresponding gutter plate surface (67). The junction of these two components is indicated as joined at an attachment point (43). In certain embodiments, the system of gutter plates (61, 67) may be a single, angled concrete cover tool including both plates (61, 67) in a one-piece construction that defines a bore (64) there through for receiving the welding bolt (63). Upon attaching the grate fitting device (40) to the concrete structure, the grate (62) may be incorporated into the lip (67) configuration noted above.

Figure 9A:
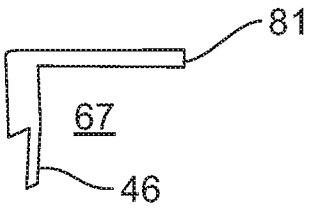
FIG. 9A illustrates a side cross section of a grate fitting device having tab connectors as illustrated in FIG. 9B.
Figure 9B:
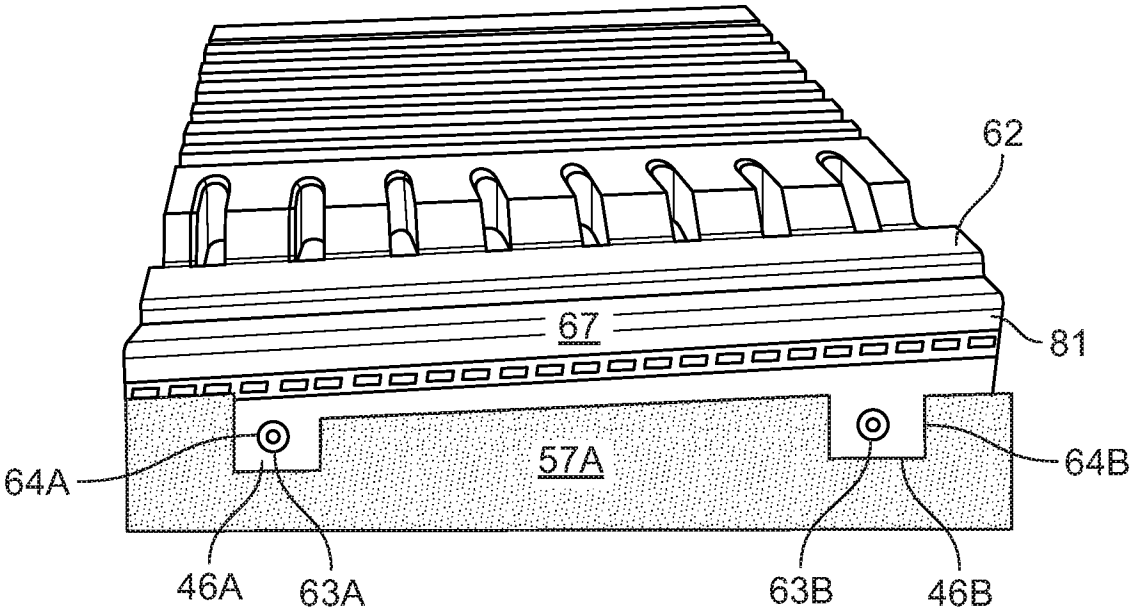
FIG. 9B illustrates a front plan view of a gutter assembly installed in a concrete pool perimeter assembly with a grate fitting device as shown in FIG. 9A.

Another perspective of the arrangement discussed for FIG. 8 is shown in FIG. 9, wherein, the grate fitting device (81) is connected to a pool wall, such as but not limited to a concrete pool wall (57A). In the embodiment of FIG. 9, the grate fitting device (81) includes the above described lip (67) defining the open configuration into which a leading edge of the pool grate (62) enters. In this embodiment, the grate fitting device (81) includes the lip (67) from which extend fitting tabs (46A, 46B) that define respective bores (64A, 64B) through which the welding bolts (63A, 63B) extend to mount the grate fitting device (67) into the concrete wall (57A). After driving the bolts (63A, 63B) into the concrete (57A), installing the grate fitting device (81) includes welding the bolts (63A, 63B) to the tabs (46A, 46B). As noted above, other means of attaching the grate fitting device to a pool wall may include adhesive, mechanical fasteners, or mating components.

The grate fitting device (39, 40, 41) may be so dimensioned in various configurations to receive a pool grate (62) therein, and the dimensions may vary, depending on the installation at hand. The grate fitting device has been illustrated herein as a generally elongated and angled structure receiving the leading edge of a pool grate, but the angled construction may also be replaced by curved edges that fit a particular style of pool grate. In other words, numerous shapes of the grate fitting device may be used to mate with and hold a corresponding pool grate in place along a perimeter of a pool. The pool grate fitting device described herein may be made of numerous materials, such as stainless steel, polymers and plastics, or any composition that suits a particular installation. As shown in the figures, most, but not all, installations position the gate fitting device (40, 41) below the top of the grate (62) such that the grate fitting device (40, 41) is below the water line in the pool, thereby not being exposed to air and corrosion. The grate fitting device further allows for grates to be positioned side-by-side about the pool perimeter with gaps between the grates that account for thermal expansion and contraction of the body of a grate (62). The absence of additional locks and fittings between the grates makes such contraction and expansion flexibility much more effective. In situations for which additional grate fixation and stability is required, a cam lock may attach the trailing edge (71) of the grate (62) to the grate support (79).

Figure 10:
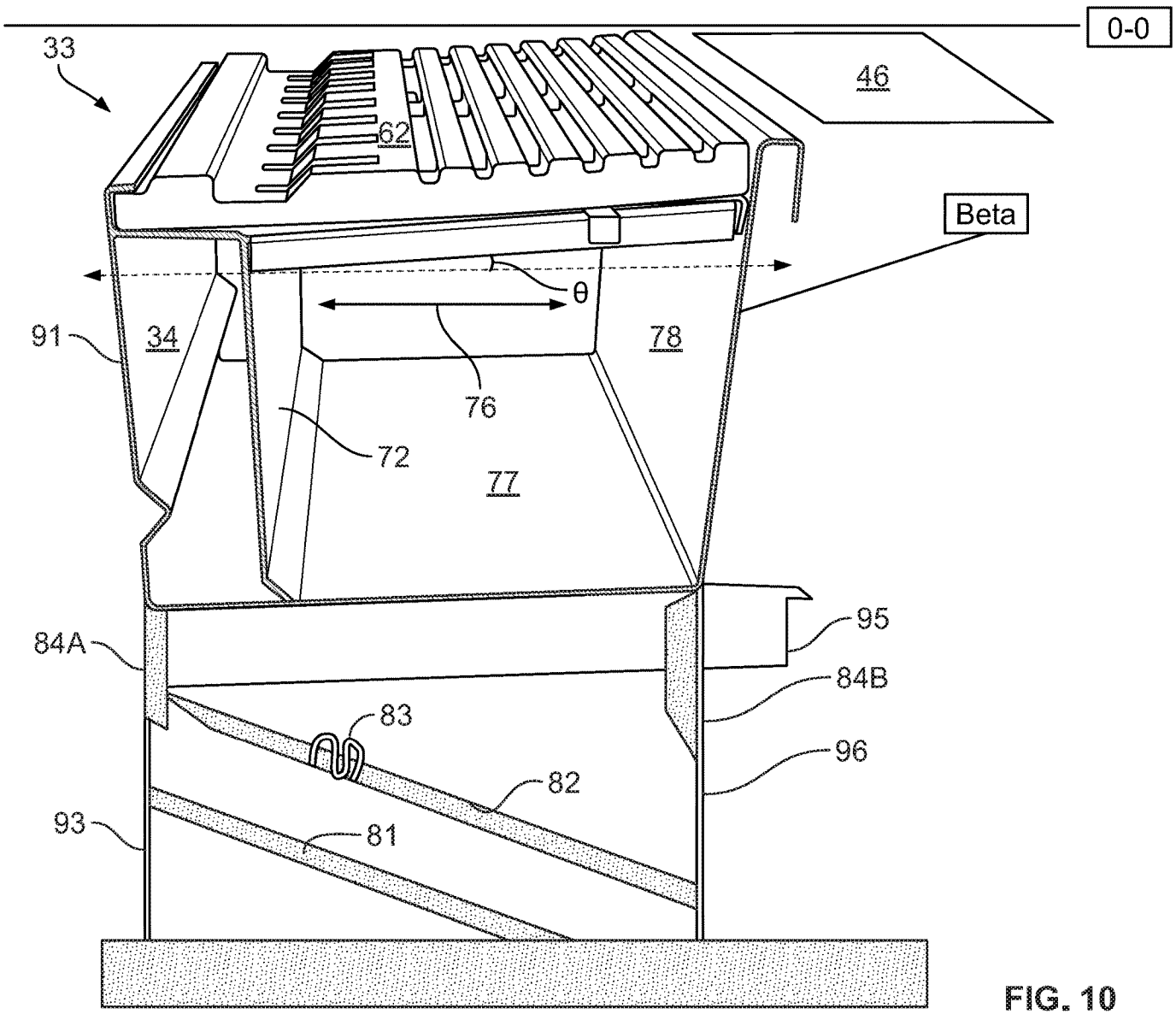
FIG. 10 illustrates a gutter assembly installed along a pool perimeter assembly and incorporating a dielectric barrier between the gutter assembly of one material such as stainless steel and a pool wall and pool perimeter assembly having another material such as a galvanized layer thereon.

FIG. 10 illustrates the concepts described above and shows the foundational structures that may be used in constructing an area around a perimeter of a pool as described herein. FIG. 10 incorporates the foundational anchors (93, 96) that support a pool perimeter assembly installed about a pool surrounding a body of liquid and positioned between a pool wall (91) and a deck (46) surrounding the pool. Liquids such as water in a swimming pool splash beyond the pool wall and into a deck drain gutter assembly (76) through the above described ports (52, 54) that are present but not directly pointed out in FIG. 10. FIG. 10 also illustrates an example arrangement of a finished pool wall (91) extending from foundational structures (99) relative to a grate (62) having a hand hold (65) that drains into the gutter trough conduit (76). In the illustration of FIG. 10, the angle of inclination is denoted as Beta relative to elevation (0-0) defined by a surface of the deck (46). Other functional characteristics of the assembly of FIG. 6 include the water return outlet (44), as shown in FIG. 11. In one embodiment, certain angled supports (81, 82) connect the foundational anchors (93, 96) and may be adjustable by threaded components (83). Gutter assembly plates (84A, 84B) provide additional fixation points. A galvanized foundation (93) and pool wall (91) may need to be attached to a gutter assembly (33) of a different material, such as a stainless steel gutter assembly. To prevent unwanted chemical reaction, surface wear, conductivity issues, and general safety concerns, a dielectric insulation layer (95) may be positioned between the gutter assembly (33) and the galvanized pool wall and foundation (91, 93).

Embodiments of this disclosure encompass not only the structures as described but also the methods of constructing and installing these components in appropriate circumstances.

The invention claimed is:

1. A deck drain apparatus for directing fluid flow around a pool, comprising:

a pool perimeter assembly defining at least two conduits extending between a first sidewall and a second sidewall, wherein the conduits are separated by a common wall between the first sidewall and the second sidewall;

a grate positioned on the pool perimeter assembly in a position to direct fluid flow into at least one of the conduits, said grate defining a hand hold section that drains into one of the conduits;

a grate fitting device connected to the pool perimeter assembly and defining a lip into which the grate enters for positioning proximate at least one of the conduits.

2. An apparatus according to claim 1, wherein the grate defines the hand hold section as an indention extending from an uppermost surface of the grate toward the pool perimeter assembly in a direction configured to drain the hand hold section into the pool perimeter assembly.

3. An apparatus according to claim 2, wherein the grate defines at least one opening extending from the uppermost surface of the grate to the pool perimeter assembly.

4. An apparatus according to claim 1 wherein the grate defines a plurality of openings that are positioned in the grate in groups such that within a respective group, the openings are parallel.

5. An apparatus according to claim 1, wherein the two conduits comprise a gutter trough conduit and an extra gutter conduit and the common wall defines a common opening between the two conduits configured such that filling the gutter trough conduit to the common opening allows for an overflow of water into the extra gutter conduit.

6. An apparatus according to claim 1, wherein the two conduits comprise a gutter trough conduit and an air exhaust conduit.

7. An apparatus according to claim 6, wherein the grate further comprises a gutter trough entry section and an air exhaust conduit entry section, wherein the gutter trough entry section is configured to receive water from the pool and the air exhaust conduit entry section is configured to receive air flow from areas around the pool.

8. An apparatus according to claim 1, wherein a first length of the assembly comprises the two conduits defining a gutter trough conduit and an extra gutter conduit and the common wall defines a common opening between the two conduits, and wherein a second length of the assembly comprises the two conduits defining a gutter trough conduit and an air exhaust conduit.

9. An apparatus according to claim 1, wherein the grate is connected to the pool perimeter assembly by a cam lock that secures the grate to the pool perimeter.

10. An apparatus according to claim 1, wherein the pool perimeter assembly is positioned between a pool wall and a pool deck at an upward incline from the pool wall.

11. A pool perimeter assembly comprising:

at least two conduits extending between a first sidewall and a second sidewall, wherein the conduits are separated by a common wall between the first sidewall and the second sidewall;

a grate positioned on the conduits in a position to direct fluid flow into at least one of the conduits;

a grate fitting device connected to the pool perimeter assembly and defining a lip into which the grate enters for positioning proximate at least one of the conduits.

12. A pool perimeter assembly according to claim 11, wherein the lip grate fitting device is a separate piece configured to be welded to at least one of the conduits.

13. An apparatus according to claim 1, wherein the two conduits comprise a water return conduit and a gutter trough conduit.

14. A pool perimeter assembly according to claim 11, wherein the lip of the grate fitting device is integral with the first side wall.

15. A pool perimeter assembly according to claim 11, wherein the two conduits comprise a water return conduit and a gutter trough conduit.

16. A pool perimeter assembly comprising, a base, a first sidewall connected to the base, a grate fitting lip angled from and integral with the first sidewall, a common wall connected to the base, the common wall being parallel to the first sidewall, a top wall extending between the first sidewall and common wall, wherein the base, first sidewall, common wall and top wall define a water return conduit, and wherein the lip, first sidewall and top wall define a grate fitting device, a second sidewall connected to the base, the second sidewall being parallel to the common wall, a grate support connected to the second sidewall, and a grate received on a leading edge in the grate fitting device and supported on a trailing edge by the grate support, wherein the base, common wall, second sidewall and grate define a gutter conduit.

17. A pool perimeter assembly as in claim 16 wherein the first sidewall has a "V" bend therein.

18. A pool perimeter assembly as in claim 16 wherein the first sidewall and lip are fabricated in one piece from stainless steel.

19. A pool perimeter assembly as in claim 16 wherein the grate is angled upwardly from the leading edge to the trailing edge.

20. A pool perimeter assembly as in claim 16 wherein the grate comprises a hand hold on its upper surface adjacent the leading edge.

21. A pool perimeter assembly as in claim 20, wherein the hand hold comprises a grip and recess indented from an uppermost surface of the grate, and said grate comprises at least one drain opening from the recess to the gutter conduit.

* * * * *